US005522337A

United States Patent [19]

Meyers et al.

[11] Patent Number: 5,522,337

[45] Date of Patent: Jun. 4, 1996

[54] UNDERWATER VEHICLE INFLATABLE HOUSING CONFIGURATION AND METHOD

[75] Inventors: Scott C. Meyers, Fountain Hills; William A. Facinelli, Phoenix, both of Ariz.

[73] Assignee: AlliedSignal Inc., Morris Township, N.J.

[21] Appl. No.: 413,064

[22] Filed: Mar. 29, 1995

[51] Int. Cl.[6] ..... B63G 8/00

[52] U.S. Cl. ..... 114/312; 244/130; 244/3.3

[58] Field of Search ..... 114/67 R, 312, 114/20.1, 20.2; 244/130, 3.27, 3.3; 102/374

[56] References Cited

U.S. PATENT DOCUMENTS

| | | | |
|---|---|---|---|
| 2,737,411 | 3/1956 | Potter | 244/130 |
| 3,204,260 | 9/1965 | Fitzmaurice . | |
| 3,412,962 | 11/1968 | Killian | 244/130 |
| 3,575,127 | 4/1971 | Wislicenus | 114/20.2 |
| 4,244,294 | 1/1981 | Frignac et al. | 102/374 |
| 4,525,999 | 7/1985 | Inman . | |
| 4,674,706 | 6/1987 | Hall | 244/3.3 |

*Primary Examiner*—Jesus D. Sotelo

*Attorney, Agent, or Firm*—Jerry J. Holden; James W. McFarland

[57] ABSTRACT

An underwater vehicle has a generally longitudinally extending housing terminating in at least one blunt end. Adjacent to and inboard of the blunt end of the longitudinally extended housing there is provided a compartment, and disposed in the compartment there is provided a folded, flexible bladder secured to a portion of the housing adjacent the blunt end and having a tapering configuration when pressurized or inflated. At or after launch of the underwater vehicle, or selectively at any other time in which it is desired to do so, an inboard mounted water pump which communicates with the interior of the bladder is operated to pressurize the bladder with regard to the surrounding ambient water, causing the tapered bladder to unfold and be extended outboard of the housing blunt end, thus streamlining the underwater vehicle.

7 Claims, 3 Drawing Sheets

UNDERWATER VEHICLE INFLATABLE HOUSING CONFIGURATION AND METHOD

FIELD OF THE INVENTION

This invention relates generally to underwater vehicles such as torpedoes and also has applicability to underwater or partially submerged structural components of water vehicles generally.

BACKGROUND OF THE INVENTION

Underwater vehicles, such as torpedoes, are generally of longitudinally elongated configuration and can present storage problems because of the length, particularly if prior to deployment they are stored in the limited confines of e.g. a submarine or even a surface ship. At the same time, it is important to configure such underwater vehicles in a fashion that promotes efficient travel through the water, a design consideration often at odds with longitudinal dimensional considerations for such an underwater vehicle.

In the prior art related to airborne missiles (as opposed to underwater vehicles), there are some examples of arrangements intended to reconfigure or augment the configuration of a missile at or after launch. For example, in U.S. Pat. No. 4,244,294, "Stowable Nozzle Plug and Method for Air Breathing Missile," a missile with an air breathing gas turbine engine is configured with a translating exhaust plug nozzle intended to minimize longitudinal length of the engine section. Specifically, a translatable exhaust nozzle plug is stowed totally within the outer confines of a missile housing and a booster rocket is attached, holding it in place. Upon release of the booster rocket, a spring shifts the translatable portion of the exhaust nozzle plug, such that it extends outside the missile housing. Alternatively, start up of the turbine engine with generation of exhaust gases is referred to as a means for extending the nozzle plug (via the pressure from the exhaust gases) as is a lanyard attached to the booster which ends up being jettisoned, with the lanyard mechanically pulling out or extending the nozzle plug.

In another prior patent related to rocket engines, U.S. Pat. No. 4,525,999, "Actuator for Deploying Flexible Bodies," there is disclosed a rocket motor nozzle extension which is flexible and in a folded position and which has a telescoping actuator assembly attached to it. A gas generator is provided which forces gas into the telescoping actuator which, in turn, extends the telescoping sections which lock in an extended position. The gas in the telescoping sections is vented.

OBJECTS AND SUMMARY OF THE INVENTION

It is an object of the present invention to provide a method and system for altering the configuration of an underwater vehicle between a more compact longitudinal configuration for storage, to a more elongated and streamlined configuration at or after launch, to facilitate more efficient in the water or under the water travel of the vehicle.

Briefly, in accordance with one embodiment of the invention, an underwater vehicle has a generally longitudinally extending housing terminating in at least one blunt end. Adjacent to and inboard of the blunt end of the longitudinally extended housing there is provided a compartment, and disposed in the compartment there is provided a folded, flexible bladder secured to a portion of the housing adjacent the blunt end. At or after launch of the underwater vehicle, or selectively at any other time in which it is desired to do so, an inboard mounted water pump which communicates with the interior of the bladder is operated to pressurize the bladder with regard to the surrounding ambient water, causing the bladder to unfold and be extended outboard of the housing blunt end, thus streamlining the underwater vehicle.

Other objects, advantages and details and alternative embodiments of the present invention will be apparent from the following detailed description taken in conjunction with the accompanying drawings, with the scope of the invention being reflected in the appended claims.

DETAILED DESCRIPTION

Figure 1:
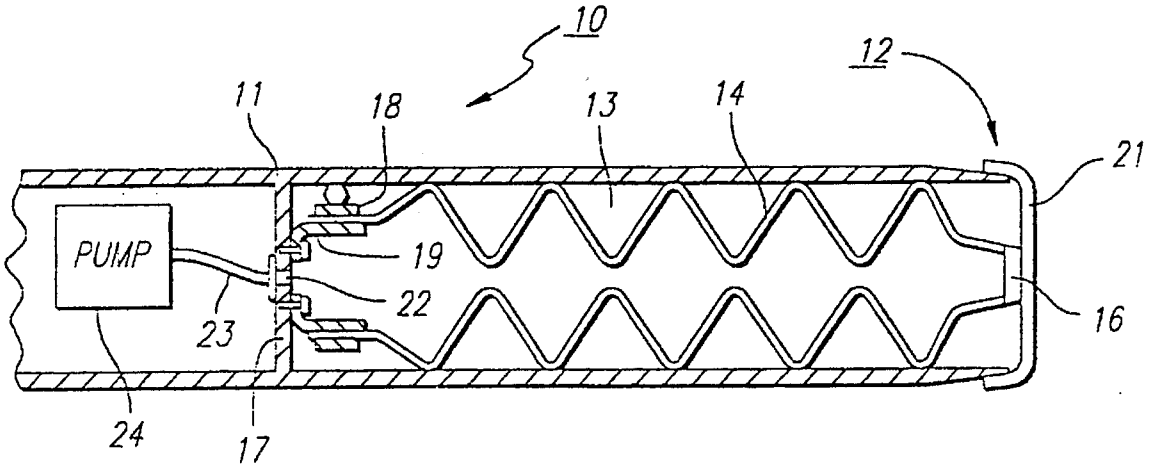
FIG. 1 is a side elevation of an underwater vehicle, partially in section and partially diagrammatic, illustrating storage of a folded bladder adjacent to a blunt end of the underwater vehicle.

Turning now to FIG. 1, there is shown in a longitudinal cross-section, partly in diagrammatic form, an example of one embodiment of the invention. In FIG. 1 an underwater vehicle generally indicated by reference numeral 10 has a generally longitudinally extending underwater rigid housing 11. The generally longitudinally extending rigid housing 11 has a blunt end 12, which in accordance with the principles of this invention can be the forward or aft section of the underwater vehicle 10, referring to forward and aft by reference to the intended travel direction of the underwater vehicle 10 through the water. Assume for the moment that what is illustrated in FIG. 1 is the aft end of an underwater vehicle, such as a torpedo. A compartment 13 is provided within the housing 11 situated adjacent to the blunt end 12 of the underwater vehicle 10. Disposed within the compartment 13 is a flexible bladder 14 which, as shown in FIG. 1, is folded upon itself such that it fits in a folded condition within the compartment 13. A rigid or semi-rigid nose portion 16 may be provided at the outboard end of the flexible bladder 14 to close and seal the flexible bladder.

As shown in FIG. 1, the flexible bladder 14 is suitably affixed to a wall 17 which can be part of the interior configuration of the rigid housing 11, and defining the compartment 13. As shown in FIG. 1, a clamping ring 18 sandwiches the open end of flexible bladder 13 to an e.g. circular clamping mandrel 19 affixed to the wall 17.

In FIG. 1 the blunt end of the underwater vehicle 10 is illustrated as being closed and/or sealed by a cover 21, which can be suitably secured to the blunt end to dose the otherwise open end of compartment 13. As illustrated in FIG. 1, the cover 21 can be held on the blunt end 12 through a springing action of the cover acting on the rigid housing wall. Alternatively, a cover can be provided which is releasably held in any of the many other fashions known in the art, such as by remotely actuated releasable clamps or bolts, physical means such as a lanyard, etc.

FIG. 1 illustrates an inlet 22 extending through the wall 17 into the closed volume bounded by the folded flexible bladder 14. Inlet 22 is connected via a suitable conduit 23 to a pump 24. The pump 24 is selectively actuated to pump ambient water from around the underwater vehicle 10 through conduit 23 and inlet 22 into the interior closed volume of flexible bladder 14. Alternatively, if pump 24 runs continuously, such as might be the case in a water jet propelled vehicle or torpedo, then pump 24 can have selectively actuatable valve means for communicating water under pressure through conduit 23 and inlet 22 into the interior of the folded flexible bladder 14.

Figure 2:
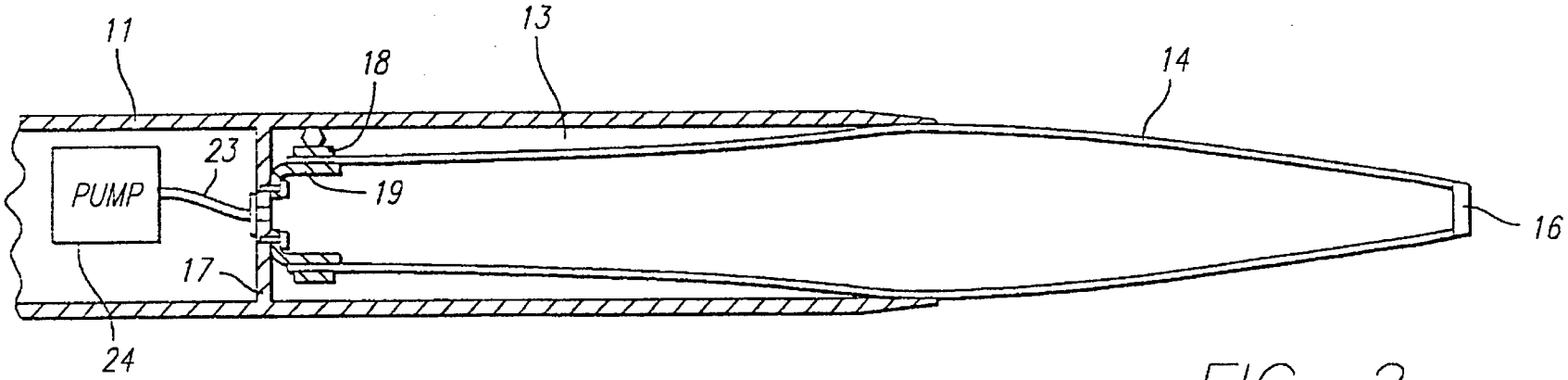
FIG. 2 is a side elevation similar to FIG. 1, which shows the bladder in an extended or inflated position.

Referring now to FIG. 2, there is shown the arrangement of FIG. 1 in which, after deployment or launch of the underwater vehicle 10 for travel through the water, the cover plate 21 has been jettisoned and the inflatable bladder 14 has been inflated, filled or pressurized with water. The bladder is reinforced with fiber so that it maintains a predetermined hydrodynamic shape. As illustrated in FIG. 2, the bladder 14 in its pressurized or inflated condition is generally of a streamlined shape narrowing down to a small diameter, and its end can be closed by the rigid plug 16 which can be made of hard rubber or the like. The inflatable bladder 14 is filled, deployed or pressurized through pump 24 being actuated to pump through conduit 23 and through inlet 22 water into the interior of the bladder 14. The resulting arrangement as shown in FIG. 2 presents a streamlined profile at the end of the underwater vehicle 10 (as opposed to the blunt end) which makes for efficient travel of the underwater vehicle through the water.

In one preferred embodiment of the invention, the inflatable bladder concept of this invention is applied to an underwater torpedo which has jet pump water propulsion as opposed to the prior propulsion techniques of open propellers or shrouded propellers. Such a jet pump configuration readily lends itself to application of this invention, inasmuch as deployment of the inflatable bladder to streamline the blunt end of the torpedo does not run afoul of or interfere with propellers or the like. In the case of this one preferred embodiment, the pump 24 can be the jet propulsion pump for the torpedo or underwater vehicle 10. This leads to several advantages, in that the pump 24 or at least the water coursing through the pump and being exited as a means of propulsion is in communication with the ambient water surrounding the torpedo or underwater vehicle. A relative pressure of only 1–3 PSI within the interior of the inflatable bladder 14 as compared to the ambient water surrounding it has been found to be quite ample for maintaining the inflatable bladder 10 in an inflated or pressurized condition as shown in FIG. 2. In the case of a torpedo or underwater vehicle 10 wherein the pump 24 is a jet propulsion pump for the torpedo or vehicle, automatic pressure equalization takes place for depths traversed by the underwater vehicle between the interior of the inflatable bladder 14 in its inflated condition as shown in FIG. 2, and the surrounding ambient water. That is, since the water being pumped out of pump 24 to propel the vehicle is in communication with the ambient water, the pressure differential between the ambient or surrounding water and the interior of the filled or pressurized inflatable bladder 14 stays relatively constant, regardless of the water depth. This is an especially important consideration for torpedoes or underwater vehicles which operate over a wide range of water depths.

Alternatively, of course, the pump 24 need not be a propulsion pump for the vehicle and can be operated to selectively inflate the bladder 14 at whatever time is desired at or after launch, through radio controls or the like sending signals to the pump 24 for actuating it and/or opening a valve to fill the interior of the bladder 14 with water. In accordance with one embodiment of the invention, the inflatable bladder 14 was constructed of neoprene infiltrated nylon fabric, the same material used for evacuation slides on airplanes. Many other suitable materials exist, however, and the bladder could be made of Kevlar, for example. The purpose of the reinforcing materials is to maintain the bladder in a desired shape after inflation.

Figure 3:
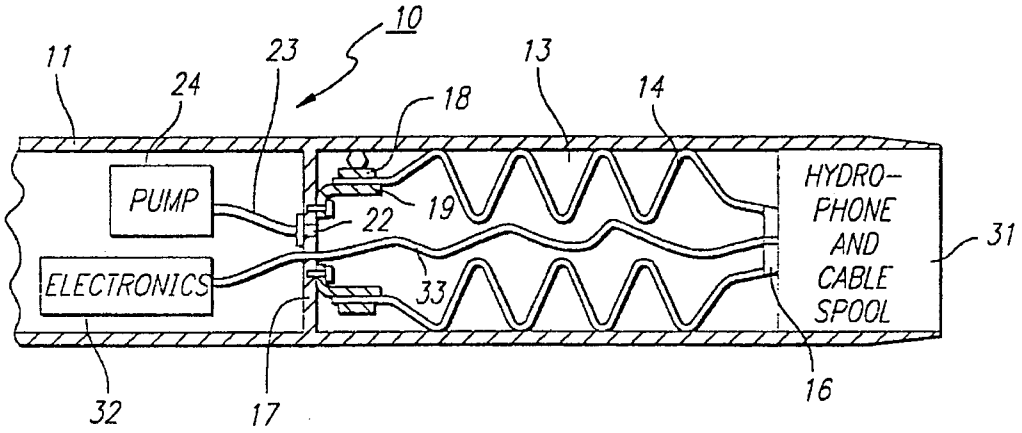
FIG. 3 is a side elevation similar to FIG. 1 illustrating an embodiment of the invention in which, stored in the compartment along with the folded bladder, there is also provided storage of a hydrophone and/or cable spool arrangement for trailing behind the underwater vehicle after launch.
Figure 4:
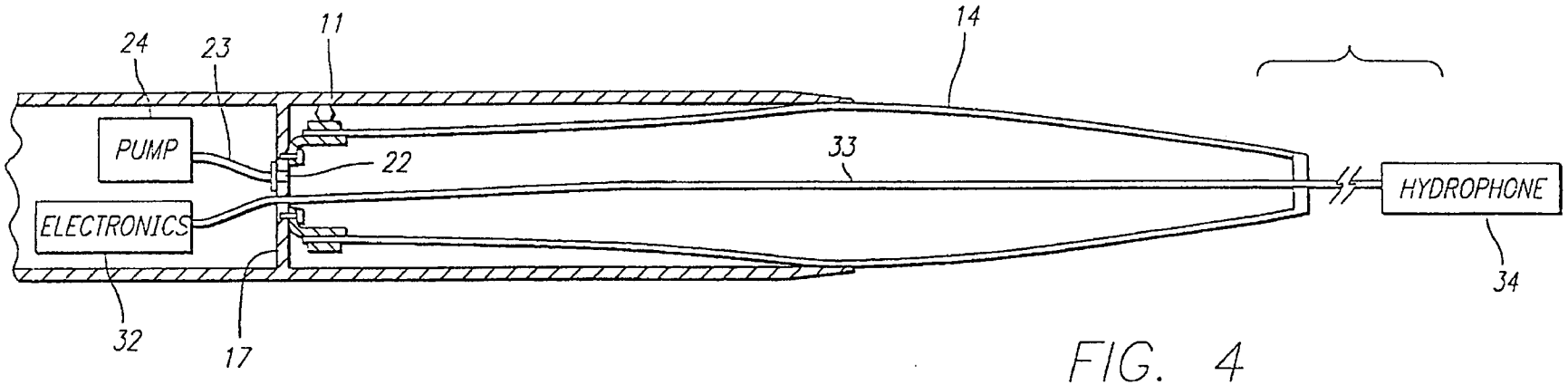
FIG. 4 is a side elevation similar to FIG. 2, but showing the bladder of the arrangement of FIG. 3 in an inflated or filled or pressurized condition.

Turning now to FIGS. 3 and 4, one particular embodiment of the invention is shown as applied to an underwater torpedo useful for towing a hydrophone array or the like, or where a spool of e.g. fiber optic cable which is connected to a mother ship or vehicle from which the torpedo is launched is utilized with the cable being deployed as the torpedo travels through the water. Like reference numerals are used in FIGS. 3 and 4 respectively as in FIGS. 1 and 2 to refer to common elements carried over from FIGS. 1 and 2 into FIGS. 3 and 4.

As before, the longitudinally extending rigid housing 11 has a compartment 13 adjacent a blunt end of the housing within which a folded flexible bladder 14 is disposed. At of the folded, flexible bladder 14 there is provided a hydrophone and cable spool assembly 31, shown only in diagrammatic form in FIG. 3. A cable for connecting the hydrophone and cable spool assembly 31 to suitable electronics assemblies 32 carried within the longitudinal housing 11 is provided and is identified by reference numeral 33 in FIG. 3. The cable 33 is held and suitably secured in a waterproof fashion by the rigid blunt end 16 of the flexible bladder and passes through in a waterproof fashion the inner wall 17 for connection to the electronics 32. Instead of a hydrophone and cable array, the assembly 31 can of course be a spool of fiber optic or other cable for deployment as the torpedo travels through the water while maintaining connection with a mother ship or other vehicle from which the torpedo was launched.

Referring to FIG. 4, there is shown the arrangement of FIG. 3 after the flexible folded bladder 14 has been inflated or pressurized by water to place it in an unfolded, extended condition as shown in FIG. 4, streamlining the blunt end of housing 11. As illustrated in FIG. 4, the cable 33 is deployed behind the extended bladder 14 for towing a hydrophone 34 or the like.

The arrangement of FIGS. 3 and 4 works particularly well in the case of torpedoes or other underwater vehicles which are propelled by a jet pump, because such a jet pump propelled vehicle has no external propeller or the like which would interfere with the extension of bladder 14 to achieve streamlining or interfere with deployment of the hydrophone and cable spool arrangement 31. Also, and as mentioned before in connection with FIGS. 1 and 2, for arrangements wherein the pump 24 supplying water to inflate the bladder 14 is the jet propulsion pump, because it is in communication with the ambient water surrounding the longitudinally extending rigid hull 11 and bladder 14, automatic pressure compensation occurs with regard to transit of the underwater vehicle through varying depths of water. It has been found that a pressure differential of only 1–3 PSI between the interior water inflating bladder 14 and the ambient water surrounding the under-water vehicle functions quite well in maintaining the flexible bladder 14 in an inflated or pressurized condition.

It has been found in experiments that extending an inflatable bladder in the fashion discussed above in connection with FIGS. 1–4 to streamline a blunt end of an underwater vehicle such as a torpedo, results in a 30% reduction of drag over the same underwater vehicle with only the blunt end.

Figure 5:
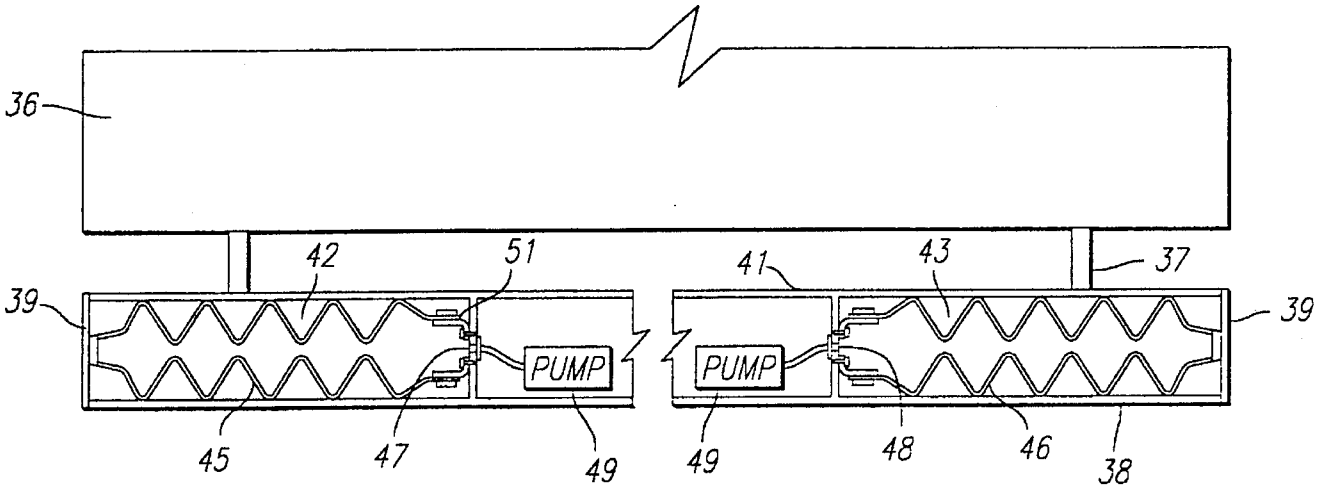
FIG. 5 is a side elevation of one component of an offshore floating structure, showing application of the selectively reconfigurable underwater pontoon portion of the structure.
Figure 6:
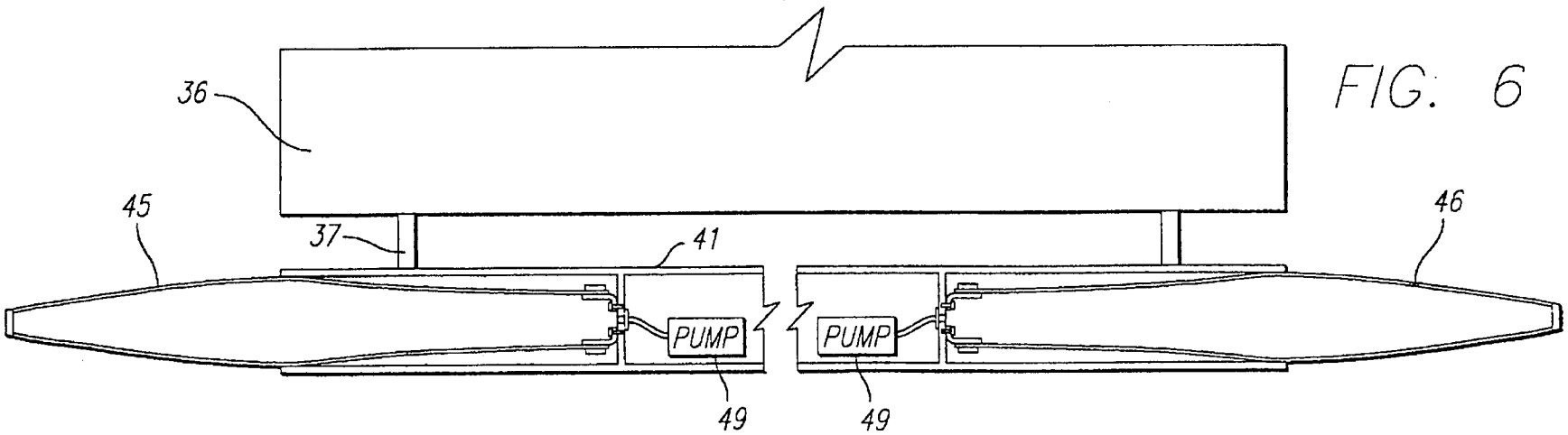
FIG. 6 is a side elevation of the arrangement of FIG. 5, showing deployment of the inflatable bladders on both ends of the pontoon arrangement of FIG. 5, for streamlining the pontoon of FIG. 5 for travel through the water.

Turning now to a consideration of FIGS. 5 and 6, there is diagrammatically illustrated another application for the principles of the invention in which a blunt end or ends of an underwater or in-the-water portion of a water vehicle is provided with a selectively deployable tapered bladder for streamlining the blunt end of the underwater or in-the-water portion for efficient transit through the water with reduced drag. It is known to assemble structures such as offshore drilling platforms and the like by transporting portions of the structure through the water to their destination. Generally, various subassemblies of such an offshore platform are separately transported through the water and then bolted or otherwise affixed together at the destination to form an overall composite structure. Because of the manner in which these various sections are assembled, it is obviously desirable to have whatever the underwater or partially in-water structure of pontoons or the like not extend past the perimeter or edge of the sections to be joined, as well as being generally planar or flat for purposes of being joined together, such that usually there is provided blunt ends to pontoons or the like supporting the various sections. While this facilitates bolting the sections together when they have been transported through the water to their destination, it results in an inefficient underwater or in-the-water design of the pontoons.

FIGS. 5 and 6 show application of the principles of this invention to pontoons, either underwater or in-the-water pontoons, for supporting and transporting sections of an offshore assembly. In the drawings, the section of the offshore assembly or the like is diagrammatically illustrated by reference numeral 36 shown as connected by struts 37 to a pontoon assembly 38. The section 36 can of course in certain cases be quite large, displacing 10,000 tons or more. The pontoon assembly 38 has suitable end sections or the like indicated by reference numerals 39 which are provided adjacent blunt ends of the generally longitudinally extending cylindrical rigid housing 41. Compartments 42 and 43 are provided adjacent the blunt ends of the pontoon assembly 38. Flexible bladders 45 and 46 are respectively disposed in the compartments 42 and 43 and are shown in FIG. 5 in the non-deployed or folded condition, and are suitably fastened through fixing means 51 (indicated only diagrammatically) in a water sealed relationship to one of the walls of the compartments 42 and 43. Water inlets 47 and 48 are provided extending within the interior volume of the bladders 45 and 46 provided in the compartments 42 and 43. The inlets 47 and 48 communicate with a pump 49. The pump 49 is adapted to be utilized to pump ambient surrounding water through the inlets 47 and 48 to expand and inflate the bladders 45 and 46. When this occurs, the general configuration of the underwater or in the water pontoon assembly 38 is as shown in FIG. 6. It has been found that differential pressures as low as 1–3 PSI between the ambient surrounding water and the water utilized to inflate bladders 45 and 46 works very satisfactorily. The pump 49 can be a selectively actuated auxiliary pump run by onboard electrical power, or can be part of the pump circuit for a jet pump propulsion unit which is used for transporting the sections for structures intended to be assembled in the water. Of course, the type of structures of which the present invention is applicable for moving sections include not only all drilling platforms and the like which end up being rigidly affixed to the bottom of the ocean, but also to floating assemblies of any and all kinds. After transiting the sections to their intended location through configuring the in the water or underwater portion of the structure as shown in FIG. 6, then the inflatable or pressurized bladders 45 and 46 may be depressurized and stored or folded back within their respective compartments in the pontoon structure 38.

While certain preferred and exemplary embodiments of the present invention have been discussed in connection with the included drawings, it should be clear that it is believed the concept and the principles of the present invention has wide application.

What is claimed is:

1. In a water vehicle having a generally longitudinally extending underwater rigid housing having at least one blunt end, means for selectively reconfiguring said blunt end comprising a compartment situated within said housing inboard said blunt end, a flexible bladder having a tapering configuration with a large end and a closed smaller end and adapted in an uninflated condition to be folded for storage such that it fits within the compartment, said large end being secured within said compartment, water inlet means extending within said compartment for communicating ambient water under pressure into said bladder to pressurize said bladder relative to ambient water to unfold, inflate and extend said bladder outboard of said blunt end, thus streamlining said underwater housing for efficient travel through the water, a water pump contained within the rigid housing communicating with said water inlet means to unfold, inflate and extend said bladder, said water pump also taking in ambient water and expelling it under pressure from one end of the water vehicle for propelling the vehicle.

2. A reconfiguring arrangement in accordance with claim 1, including a cover plate releasably secured to said at least one blunt end of the underwater rigid housing to cover said compartment containing said bladder in a folded condition.

3. A reconfiguring arrangement in accordance with claim 1 including a cable spool assembly contained in said compartment aft of the bladder in a folded condition and for deployment outside the water vehicle when the bladder is inflated with water.

4. In a structural section for an assembled-in-the-water structure, the section being of the type intended for transport through the water to an intended destination and being there assembled with other sections to form the in-the-water structure, the structural section including at least one generally longitudinally extending rigid pontoon section in or under the water, said pontoon section having a blunt end, the improvement comprising a compartment situated within said rigid pontoon section inboard said blunt end, a flexible bladder having a tapering configuration with a large end and a closed smaller end and adapted in an uninflated condition to be folded for storage such that it fits within the compartment, said large end being secured within said compartment, water inlet means extending within said compartment for communicating ambient water under pressure into said bladder to pressurize said bladder relative to ambient water to unfold, inflate and extend said bladder outboard of said blunt end, thus streamlining said underwater housing for efficient travel through the water.

5. A structural section in accordance with claim 4 wherein said pontoon section having a blunt end is intended for and configured for mating with and being assembled to other blunt ends of pontoon sections of other structural sections.

6. A structural section in accordance with claim 4 including a water pump contained within the structural section communicating with said water inlet means to unfold, inflate and extend said bladder.

7. A structural section in accordance with claim 4 wherein said water pump also functions to take in ambient water and expel it under pressure from one end of the structural section or pontoon for propelling the structural section through the water.

* * * * *